United States Patent [19]

Carberry

[11] Patent Number: 4,822,430

[45] Date of Patent: Apr. 18, 1989

[54] METHOD AND APPARATUS FOR CLEANING BOILER BURNERS

[76] Inventor: Victor V. Carberry, N55 W21404 Logan Dr., Menomonee Falls, Wis. 53051

[21] Appl. No.: 768,128

[22] Filed: Aug. 22, 1985

[51] Int. Cl.[4] ..... B08B 5/04

[52] U.S. Cl. ..... 134/21; 15/316 A; 15/312 R; 15/319; 15/320; 15/406; 55/356; 55/418; 55/341.2

[58] Field of Search ..... 15/316 A, 317, 318, 15/316 R, 312 R, 319, 320, 406; 134/21, 6; 55/356, 418, 341 NT

[56] References Cited

U.S. PATENT DOCUMENTS

| | | | |
|---|---|---|---|
| 3,896,520 | 7/1975 | Williams | 15/320 |
| 4,115,896 | 9/1978 | Costanzo | 134/21 |
| 4,174,549 | 11/1979 | Michelson | 15/318 |
| 4,287,635 | 8/1981 | Jacobs | 15/321 |
| 4,393,538 | 7/1983 | Olson | 15/320 |
| 4,464,810 | 8/1984 | Karpanty | 15/320 |

*Primary Examiner*—H. M. S. Sneed
*Assistant Examiner*—Sharon T. Cohen
*Attorney, Agent, or Firm*—Michael, Best & Friedrich

[57] ABSTRACT

A method and apparatus for use in cleaning residue from boiler tubes including a housing having an upper chamber and a lower chamber separated by a wall having a plurality of openings permitting airflow from the lower chamber into the upper chamber. A vacuum is generated in the upper chamber and filter bags surround the openings for filtering air flowing through said openings. A vacuum hose is connected to the lower chamber and is adapted to be connected to one end of the boiler tube. An air driven tool is inserted into the opposite end of the boiler tube to remove material from the inside of the boiler tube. The bottom of the lower chamber defines a trough adapted to receive particulate material cleaned from the elongated tubes. An auger is housed in the trough for selectively discharging the particulate material from the trough. A spray nozzle is also provided for wetting soot as it is discharged from the trough.

32 Claims, 3 Drawing Sheets

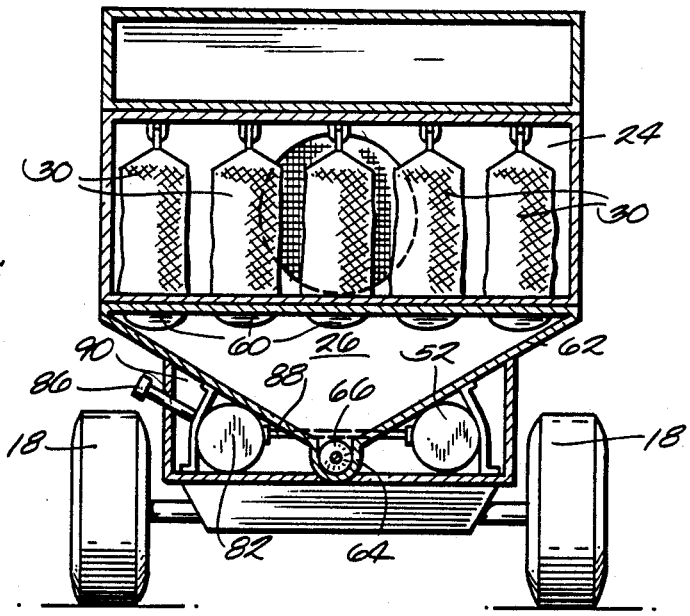
Fig. 5
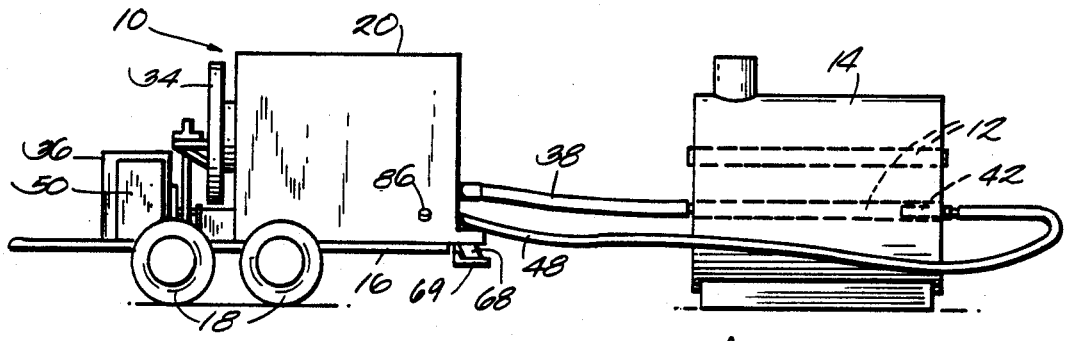
Fig. 1
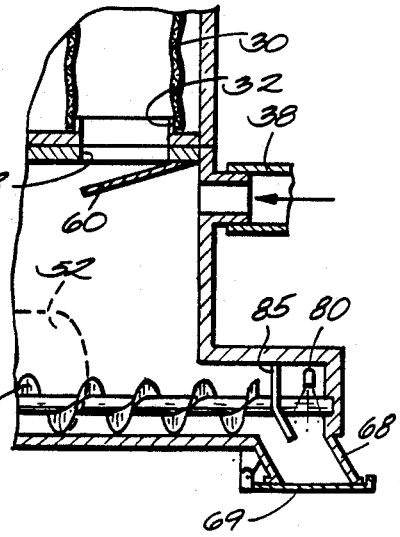
Fig. 6
Fig. 2.
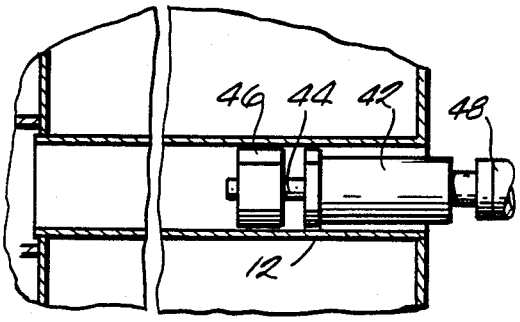

METHOD AND APPARATUS FOR CLEANING BOILER BURNERS

FIELD OF THE INVENTION

The present invention relates to methods and apparatus for use in removing soot from tubes of boiler burners and methods and apparatus for use in cleaning and removing residue from the interior of other elongated tubes.

BACKGROUND PRIOR ART

Efficient operation of a boiler requires that the boiler be cleaned periodically to remove soot and other residue from the boiler burner tubes. Combustion of gas or oil in the boiler produces soot which accumulates in the boiler tubes. In the prior art methods for cleaning boiler tubes, a rotary tool is inserted into a boiler tube and rotates in the tube to loosen soot and other materials adhering to the inside of the boiler tube. A vacuum cleaner is then used to remove the soot from the boiler. This soot normally comprises very fine powdery dust and the cleaning and vacuuming process is a dusty procedure. Following vacuuming, the soot contained in the vacuum cleaner must then be disposed of. Because of the dust generated by the soot, in many cases the soot may not be dumped or otherwise disposed of from the vacuum without first being placed in bags or otherwise placed in containers. The operator must empty the vacuum into bags and this process also generates dust. Additionally, the process of first reaming the boiler tubes and then vacuuming is not completely efficient and once the soot dust becomes entrained in the air, it is difficult to completely clean the boiler area.

SUMMARY OF THE INVENTION

The present invention includes a method and apparatus comprising an improved means for cleaning soot from a boiler in a manner minimizing the generation of dust during the boiler cleaning operation. The method and apparatus of the invention also provides a means for disposing of the soot such that the soot can be deposited at a dump site without the generation dust and alternatively, the soot can be conveniently emptied into bags with a minimum of handling and without the generation of dust.

The apparatus embodying the invention can comprise a vehicle including a housing, with a horizontal wall separating the interior of the housing into an upper vacuum chamber and a lower chamber for storage of soot. The horizontal wall includes a plurality of apertures to permit airflow from the lower soot storage chamber into the upper vacuum chamber. A plurality of filters are also provided, with one filter provided for each aperture. A fan is connected to the upper vacuum chamber for drawing air from the upper vacuum chamber and for generating a vacuum in the vacuum chamber. A motor is provided for driving the fan. A vacuum hose is connected to the lower chamber. Soot can be drawn through the hose into the lower chamber. As the air is drawn through the filters from the lower chamber into the upper chamber, the filters will separate the particulate matter from the airflow, and the particulate matter can fall into the lower chamber of the housing.

A vacuum hose is connected to the lower chamber and an end of the vacuum hose can be used to draw soot from the boiler tubes. The apparatus embodying the invention also includes a reaming tool adapted to be inserted into an opposite end of the boiler tubes to ream the inside of the boiler tubes. In the preferred form of the invention means are also provided for directing a blast of air from that end of the tube containing the rotary tool to the opposite end of the tube and toward the end of the vacuum hose. The combination of the vacuum hose and the air blast will cause airflow through the boiler tube, and soot and any other solid material loosened by the rotary tool will be drawn into the vacuum tube. The apparatus of the invention provides a means for capturing the soot from the boiler tubes as it is removed by the rotary tool and controls the soot and dust during the cleaning operation. The vacuum arrangement efficiently captures all of the soot and prevents the generation of dust during the cleaning operation.

The apparatus embodying the invention also includes a means for discharging the soot from the lower chamber of the container or housing in a manner minimizing the generation of dust. The bottom of the lower chamber includes downwardly sloping walls terminating in a trough extending along the length of the lower chamber. An auger is housed in the trough and is selectively rotatably driven so as to convey soot toward a discharge end of the trough. The discharge end of the trough includes an outlet, and means are provided at the outlet for wetting the soot as it is discharged from the outlet, the means for wetting substantially eliminating the dust as the soot is discharged from the trough. The soot can be discharge directly into a disposal area, or the soot can be discharged into bags.

One of the principal features of the invention is that apparatus of the invention can be embodied in a single vehicle or trailer and can be conveniently used to clean boilers while minimizing the generation of dust or other pollutants.

Another of the principal features of the invention is that the apparatus simultaneously vacuums soot from the boiler tubes and also mechanically cleans the interior of the boiler tubes to thereby provide an effective means for removing soot and other residue materials from the boiler burner without requiring expensive subsequent clean-up steps. Using the apparatus of the invention, control is maintained during the entire cleaning operation and the soot is not allowed to disburse. One of the features of the invention which results in such control over the soot is produced by extending a cleaning tool into one end of a tube to be cleaned while providing the vacuum hose at the opposite end of that tube.

Various other features and advantages of the invention will be apparent by reference to the following description of a preferred embodiment, from the claims and from the drawings.

BRIEF DESCRIPTION OF THE DRAWINGS

FIG. 1 is a side elevation view of apparatus embodying the invention used in cleaning a boiler.

FIG. 5 is a end cross section view taken along line 5—5 in FIG. 3.

FIG. 6 is an enlarged partial view of apparatus illustrated in FIG. 3.

FIG. 7 is an enlarged cross section view taken along line 7—7 in FIG. 3.

Figure 3:
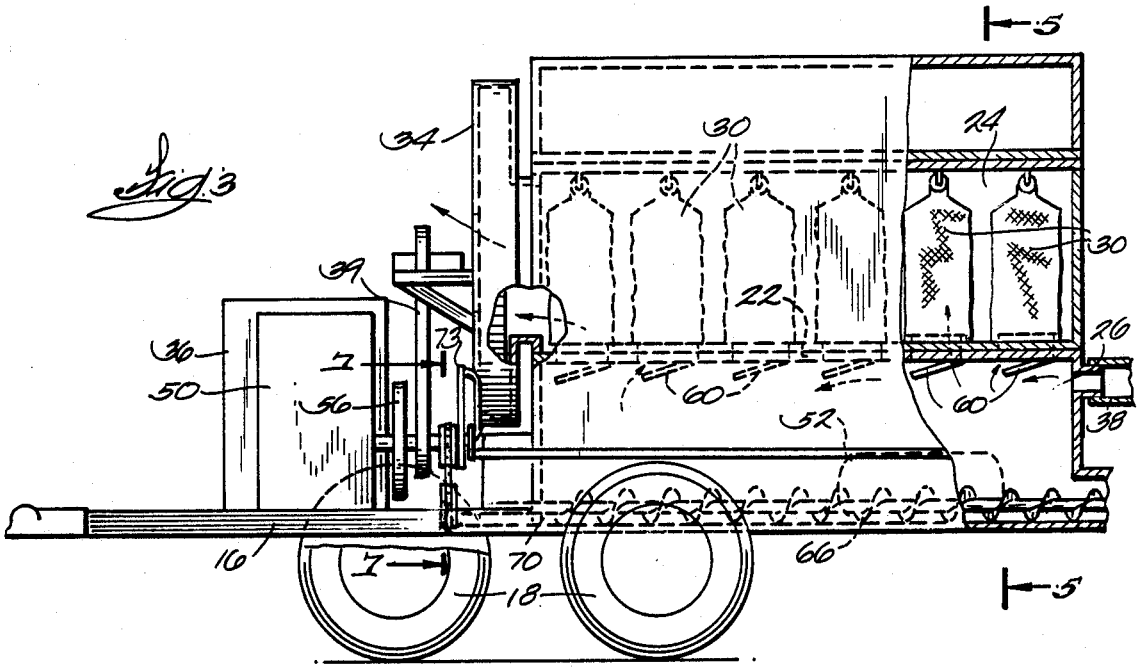
FIG. 3 is an enlarged partial cross section elevation view of apparatus illustrated in FIG. 1.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a vehicle 10 embodying the present invention and for use in cleaning apparatus such as boiler burner tubes 12 of a boiler 14 to remove soot and other residue adhering to the interior surfaces of the tubes 12, and for disposing of the material removed from the boiler tubes 12 in an efficient manner and without the generation of substantial quantities of dust.

While in the illustrated arrangement the apparatus embodying the invention is shown as being used to clean the tubes 12 of a boiler 14, it will be understood that the apparatus could be used in many other applications.

While in the illustrated arrangement, the vehicle 10 is a trailer of the type adapted to be towed by a truck or car, in other arrangements the cleaning apparatus could be mounted directly on a truck.

The vehicle 10 includes a rigid frame 16 supported by wheels 18 supporting a housing 20 comprising a closed container, the container including a central chamber divided by a horizontal wall 22 to form an upper chamber 24 comprising a vacuum chamber and a lower chamber 26 adapted to comprise a receptacle for containing soot. The horizontal wall 22 includes a plurality of spaced apart openings 28 (FIG. 6), and each opening 28 is surrounded by an open end of a filter bag 30. The filter bags 30 are formed from a suitable fabric and function to filter air passing from the lower chamber 26 through the openings 28 into the upper vacuum chamber 24. While the filter bags 30 could be secured to the horizontal wall 22 in various ways so as to surround the openings 28, in the illustrated construction, each opening 28 is surrounded by a circular flange 32 extending upwardly into the upper vacuum chamber and the open end of the filter bag 30 surrounds the flange 32 and is secured to the flange 32 such that the filter bag is rigidly held in place. The filter bags 30 are conventional and are of the type commonly used in dust collectors and other similar apparatus.

Means are also provided for generating a vacuum in the upper chamber 24 of the housing. While various means could be provided for generating the vacuum, in a preferred form of the invention a fan 34 is mounted adjacent a forward portion of the housing. A motor 36 is drivingly connected by a drive belt 39 to the fan 34 to drive the fan, and the fan 34 communicates with the upper chamber 24 of the housing such that the fan 34 draws air from the upper chamber.

The apparatus embodying the invention further includes a vacuum hose 38 (FIGS. 1 and 3) having one end adapted to be connected to the lower chamber 26 of the housing 20 and an opposite end of the vacuum hose 38 is used to remove soot and other loose residue from the boiler 14.

Figure 2:
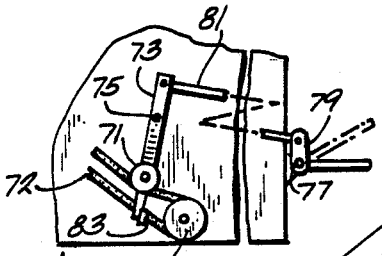
FIG. 2 is an enlarged partial cross section view of the apparatus illustrated in FIG. 1.

Means are also provided for reaming the boiler tubes 12 to loosen residue material such as soot and other combustion products from the boiler tubes. In the illustrated construction the means for reaming the boiler tubes 12 comprises a conventional pneumatically operated air turbine 42 (FIG. 2). The air turbine 42 is commercially available and includes a forwardly extending driven shaft 44 supporting rotary scraper blades 46. The scraper blades 46 and rotary tool 42 are of a size such that they can be inserted into the end of the boiler tubes 12 and then moved along the length of the tubes to remove soot and other materials from the boiler tubes. An air hose 48 is connected to a rearward end of the air turbine 42, and the air hose 48 provides compressed air to the air turbine 42 to drive the scraper blades. The compressed air discharged by the air turbine 42 generates a forward air blast through the boiler tube 12 and tends to blow the loosened soot and other residue material in the boiler tube toward opposite end of the boiler tube.

The apparatus embodying the invention also includes an air compressor 50 (FIG. 3) operably connected to an air pressure tank 52. The hose 48 is connected to the air pressure tank 52 and provides air pressure to drive the air turbine 42. While the air compressor 50 could be driven in various ways, in a preferred form of the invention, the air compresser 50 is mounted adjacent the motor 36 and is selectively drivingly connected to the motor by a drive belt 56.

In operation of the boiler tube cleaning apparatus, as illustrated in FIG. 1 and FIG. 2, the scraper blades 46 and air turbine 42 are inserted into one end of the boiler tube 12, and an end of the vacuum hose 38 is positioned adjacent an opposite end of the boiler tube. As the scraper blades 46 loosen the soot from the interior of the tube 12, the compressed air exhausted by the air turbine will blow the soot toward the opposite end of the boiler tube 12. The vacuum hose 38 will also draw air and soot through the boiler tube 12. Substantially all of the soot and other particles from the boiler tube will be drawn into the vacuum hose 38 as they are loosened by the rotary scraper blades 46, and the soot and other particles will not be allowed to disburse into the boiler room. In operation of the vacuum hose 38, it need not be connected directly to the end of the boiler tube 12. If the end of the vacuum hose 38 is held within one to two inches from the end of the boiler tube 12, it will draw the soot through the boiler tube and will prevent disbursement of the soot in the atmosphere.

As shown in FIG. 3 the soot from the vacuum tube 38 is drawn into the lower chamber 26 of the housing 20. As the air containing the soot flows through the openings 28 into the upper chamber 24 of the housing, the fabric filter bags 30 will remove this soot and other particles from the airstream, and this material will fall to the bottom of the lower chamber 26.

In one preferred form of the invention, baffles 60 (FIG. 3) are provided adjacent each opening 28 and function to aid in the separation of particulate material from the air flowing into the vacuum chamber 24. While the baffles 60 could be constructed in various ways, in a preferred form of the invention, the baffles comprise circular plates having a diameter approximating that of the openings in the horizontal wall and are inclined downwardly and forwardly. As air flows forwardly into the lower chamber 26 from the rearward end of the chamber, the air will impinge against the baffles 60, and the particulate matter will tend to fall to the bottom of the lower chamber 26.

As shown in FIG. 5 In a preferred form of the invention, the lower chamber portion of the housing includes downwardly sloping and converging sidewalls 62, the downwardly sloping sidewalls 62 terminating in an elongated trough 64 extending from a forward portion of the housing 20 to a rearward portion of the housing.

Figure 4:
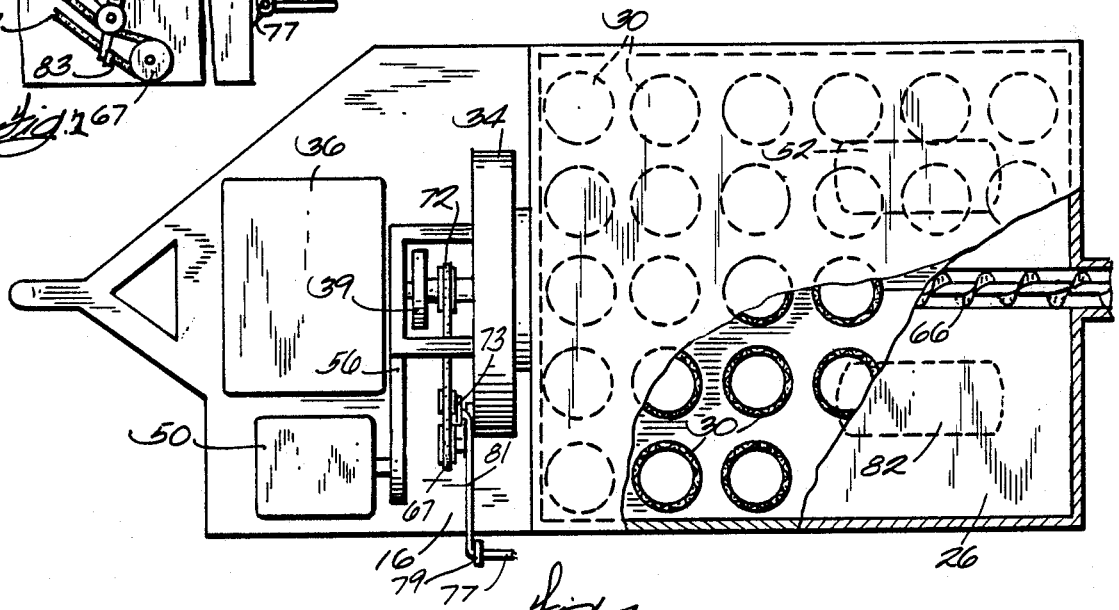
FIG. 4 is a plan view of the apparatus illustrated in FIG. 3 with portions broken away.

As shown in FIG. 3 and 5 means are also provided for emptying soot from the housing 20. In a preferred form of the invention this means includes an auger 66 housed in the trough and rotatable to cause the soot material in the trough 64 to be conveyed to a discharge chute 68 at the rearward end of the trough. Means are also provided for selectively rotatably driving the auger 66. While various means (FIG. 4) could be provided, in one arrangement a pulley 67 can be mounted on the forward end of the auger shaft 70 and can be selectively connected by a drive belt 72 to a drive pulley driven by the motor 36. In the illustrated arrangement (in FIG. 7) a shiftable idler pulley 71 is provided for causing selective driving engagement of the drive belt 72 with the pulley 67. The idler pulley 71 is supported by one end of a level 73 supported for pivotal movement about a pivot 75. A handle 75, at the rearend of the trailer and adjacent the discharge chute 68, is connected to the upper end of the lever 73 by an elongated horizontally extending shaft 77 (FIG. 3), by a lever 79 (FIG. 7) and by a connecting rod 81. The lower end of the lever 73 also supports a brake pad 83 selectively engageable with the pulley 67 to brake the auger 66 when the lever 73 is moved from an auger drive position to an auger idle position.

In the illustrated arrangement, (in FIG. 6) the discharge chute 68 can comprise a conduit extending downwardly from the bottom of the rearwardly projecting end of the trough 64. The discharge chute 68 is constructed such that an open end of a waste storage bag can be placed around the conduit and secured in place. The lower chamber 26 can then be emptied directly into the waste storage bag. In the illustrated arrangement a hinged door or gate 69 is provided for selectively closing the discharge chute 68 during the vacuuming operation.

As shown in FIG. 6 means are also provided for wetting the soot as it is discharged through the discharge chute to thereby prevent generation of dust during the discharge operation. In the illustrated arrangement, one or more spray nozzles 80 are supported adjacent an upper end of the discharge chute 68 and direct a spray of water or other liquid downwardly into the discharge chute 68. A baffle plate 85 is provided to prevent the water from nozzle 80 from entering the auger 66. The apparatus also includes a water tank 82 supported by the frame 16 and adjacent a rearward end of the frame. A water line 84 extends from the bottom of the water tank 82 to the spray nozzle 80.

In a preferred form of the invention, as shown in FIG. 5 means are also provided for pressurizing the water tank 82 such that the water supplied to the spray nozzle is under pressure. In the illustrated arrangement, a cap 86 is provided for sealing the filling opening of the water tank 82 and an air line 88 connects the top of the water tank 82 to the air tank 52. The compressed air in the water tank will provide pressure in the water tank. In one preferred form of the invention, the air line connecting the air tank to the water tank can include a restriction orifice to limit air flow from the air tank 52 to the water tank 82. A control valve can also be provided in the water line to control the flow of water to the nozzle and to provide for selected operation of the nozzle. The water tank 82 is filled by removing a cap 86, and filling the tank through the filling neck 90. The effect of the wetting operation can be increased by adding a small quantity of wetting agent to the water in the water tank 82. Such wetting agents are commercially available and are commonly used in mixing water with powdered solid materials.

Various features of the invention are set forth in the following claims:

I claim:

1. Apparatus for use in cleaning soot and combustion residue from an elongated tube of a boiler, the elongated tube having opposite ends, the apparatus comprising:

a frame, a housing supported by the frame, the housing including a first chamber portion, a second chamber portion below said first chamber portion and means for separating said first chamber portion from said second chamber portion, said means for separating including a generally horizontal wall having a plurality of apertures, said apertures providing for airflow from said second chamber portion to said first chamber portion, means for generating a vacuum in said first chamber portion, means for filtering air flowing through said apertures from said second chamber portion to said first chamber portion, said means for filtering including at least one filter bag housed in said first chamber portion, means for connecting a vacuum hose to said second chamber portion;

a trough positioned at the bottom of said second chamber portion and adapted to receive particulate material cleaned from the elongated tube, and means for selectively discharging the particulate material from said trough, said means for discharging including an auger housed in said trough and means for selectively driving said auger.

2. Apparatus as set forth in claim 1 and further including means providing a source of air pressure, said means providing a source of air pressure including a pressure tank supported by said frame, and an air compressor operably connected to said air pressure tank.

3. Apparatus as set forth in claim 2 wherein said means for generating a vacuum in the first chamber includes a fan supported by said frame, and a motor drivingly connected to said fan to drive said fan, said motor being supported by said frame, and wherein said motor is drivingly connected to said air compressor to drive said air compressor.

4. Apparatus as set forth in claim 1 wherein said means for generating a vacuum in the first chamber includes a fan supported by said frame, and a motor drivingly connected to said fan to drive said fan, said motor being supported by said frame.

5. Apparatus as set forth in claim 1 wherein trough includes a discharge opening wherein soot is discharged from said trough and further including means for spraying liquid on the soot discharged through said discharge opening.

6. Apparatus as set forth in claim 5 wherein said means for spraying includes a water tank supported by said frame, at least one spray nozzle adjacent said discharge opening and means connecting said spray nozzle to said water tank.

7. Apparatus as set forth in claim 6 and further including means providing a source of air pressure, said means providing a source of air pressure including a pressure tank supported by said frame, and an air compressor operably connected to said air pressure tank.

8. Apparatus as set forth in claim 7 and further including means for connecting said air pressure tank to said water tank to generate air pressure in said water tank.

9. Apparatus for use in removing combustion residue particulate material from an elongated tube of a boiler having opposite ends, the apparatus comprising:

a container including a vacuum chamber and a refuse containing chamber, the vacuum chamber being above the refuse containing chamber, means for generating a vacuum in said vacuum chamber, a generally horizontal wall separating said vacuum chamber and said refuse containing chamber, and at least one aperture in said wall to provide air flow from said refuse containing chamber to said vacuum chamber, means for filtering air flowing through said aperture from said second chamber portion to said first chamber portion, said means for filtering including at least one filter bag housed in said first chamber portion, a vacuum hose having opposite ends, one of said opposite ends being connected to said refuse containing chamber and the other of said opposite ends being adapted to be positioned adjacent one of the opposite ends of the elongated tube of the boiler to draw air through the tube into said vacuum hose, a source of air pressure, and and air pressure hose having opposite ends, one of said opposite ends of said air pressure hose being connected to said source of air pressure and another of said air pressure hose opposite ends being adapted to be connected to an air pressure operated cleaning tool and being adapted to be inserted into the other of the opposite ends of the elongated tube of the boiler, and said refuse containing chamber having a bottom portion including a trough adapted to receive material removed from the interior of the elongated tube.

10. Apparatus as set forth in claim 9 and further including means for selectively discharging the material from said trough, said means for discharging including an auger housed in said trough and means for selectively rotatably driving said auger.

11. Apparatus as set forth in claim 10 wherein said trough has a discharge opening and further including means for spraying liquid onto said materials discharged through said discharge opening.

12. Apparatus as set forth in claim 11 wherein said means for spraying includes a water tank supported by said frame, at least one spray nozzle adjacent said discharge opening, and means for connecting said spray nozzle to said water tank.

13. Apparatus as set forth in claim 12 and further including means for providing a source of air pressure, said means for providing a source of air pressure including air pressure tank supported by said frame, and an air compressor operably connected to said air pressure tank.

14. Apparatus for use in cleaning soot and combustion residue from the interior of an elongated tube of a boiler, the elongated tube including open opposite ends, the apparatus comprising:

a frame, a housing supported by the frame, the housing including a first chamber portion, a second chamber portion, and means for separating the first chamber portion from the second chamber portion, said means for separating including a wall having at least one opening between said first chamber portion and said second chamber portion, said opening providing for air flow from said second chamber portion to said first chamber portion, means for generating a vacuum in said first chamber portion, means for filtering air flowing through said opening from said second chamber portion to said first chamber portion, a vacuum hose having opposite ends, one of said opposite ends being connected to said second chamber portion, and the other of said opposite ends of said vacuum hose being adapted to be positioned adjacent one of the opposite ends of the elongated tube to remove soot and combustion residue from the elongated tube, means providing a source of air pressure including an air pressure tank supported by said frame, and an air compressor supported by said frame and operably connected to said air pressure tank, an air pressure hose having opposite ends, one of said air pressure hose opposite ends being connected to said source of air pressure, and a compressed air driven tool operably connected to the other of said opposite ends of said air pressure hose, said air driven tool being adapted to be inserted into the other end of the elongated tube for cleaning soot and combustion residue from the interior of the elongated tube.

15. Apparatus as set forth in claim 14 and further including a trough positioned at the bottom of said second chamber and adapted to receive material removed from the interior of the elongated tube, and means for selectively discharging the material from said trough, said means for discharging including an auger housed in said trough and means for selectively rotatably driving said auger.

16. Apparatus as set forth in claim 15 wherein said trough has a discharge opening and further including means for spraying liquid onto said materials discharged through said discharge opening.

17. Apparatus as set forth in claim 16 wherein said means for spraying includes a water tank supported by said frame, at least one spray nozzle adjacent said discharge opening, and means for connecting said spray nozzle to said water tank.

18. Apparatus as set forth in claim 14 and further including means for providing a source of air pressure, said means providing a source of air pressure including an air pressure tank supported by said frame, and an air compressor operably connected to said air pressure tank.

19. Apparatus as set forth in claim 18 wherein said means for generating a vacuum in a first chamber includes a fan supported by said frame and a motor drivingly connected to said fan to drive said fan, said motor being supported by said frame and wherein said motor is drivingly connected to said air compressor to drive said air compressor.

20. A method for removing soot from elongated tubes of a boiler and for disposing of the soot, and wherein a vacuum container is provided, the vacuum container including an upper vacuum chamber portion and a lower chamber portion adapted to house particulate material, wherein a vacuum hose is provided, the vacuum hose having opposite ends and one of said opposite ends being connected to said vacuum container, and wherein a compressed air hose is provided, the compressed air hose having one end operably connected to a source of air pressure, the opposite end of the air hose being connected to a rotary tool, the method comprising the steps of:

positioning said rotary tool in one end of said tube to clean particulate matter from the interior of said tube and for causing air flow through said tube toward said opposite end of said tube, positioning the other of said opposite ends of said vacuum hose adjacent said opposite end of one of the elongated tubes of the boiler, and drawing air and soot from said tube into said chamber, and subsequently discharging soot from said container, said step of discharging including the step of spraying liquid onto the soot to wet the soot and prevent the formation of dust.

21. Apparatus for use in cleaning particulate material, the apparatus comprising:

a frame, a housing supported by the frame, the housing including an upper chamber portion, a lower chamber portion beneath the upper chamber portion and means for separating said upper chamber portion from said lower chamber portion, said means for separating including a wall having a plurality of apertures, said apertures providing for airflow from said lower chamber portion to said upper chamber portion, means for generating a vacuum in said upper chamber portion, means for filtering air flowing through said apertures from said lower chamber portion to said upper chamber portion, said means for filtering including at least one filter bag suspended in said upper chamber portion, said filter bag including an open lower end adjacent one of said apertures whereby air flowing from said lower chamber portion to said upper chamber portion through said one of said apertures will flow through said filter bag, a vacuum hose having opposite ends, one of said opposite ends being connected to said lower chamber portion whereby air is drawn through said vacuum hose, and an opposite end adapted to be positioned to receive the particulate material, a trough positioned at the bottom of said lower chamber portion and adapted to contain the particulate material, said trough including a discharge opening in one end, and means for selectively discharging the particulate material from said trough through said discharge opening, said means for discharging including an auger housed in said trough, and means for selectively driving said auger.

22. Apparatus as set forth in claim 21 wherein said frame is supported by wheels for movement along the ground, and wherein said frame is adapted to be towed by a vehicle.

23. Apparatus as set forth in claim 21 and further including means comprising a source of pressurized air supported by the frame, an air pressure hose having one end connected to said source of pressurized air and an opposite end, an air pressure operated cleaning tool connected to the opposite end of the air pressure hose.

24. Apparatus as set forth in claim 21 and further including means for wetting the particulate material discharged through said discharge opening by said auger as the particulate material is discharged through said discharge opening.

25. Apparatus as set forth in claim 24 wherein said means for wetting includes a water tank supported by said frame, at least one spray nozzle adjacent said discharge opening and means connecting said spray nozzle to said water tank.

26. Apparatus as set forth in claim 25 and further including means providing a source of air pressure, said means providing a source of air pressure including a pressure tank supported by said frame, and an air compressor operably connected to said air pressure tank, and means for connecting said air pressure tank to said water tank to generate air pressure in said water tank.

27. Apparatus for use in removing soot and combustion residue material from an elongated tube of a boiler having opposite ends, the apparatus comprising:

a container including a vacuum chamber, a refuse containing chamber and means for separating the vacuum chamber from the refuse containing chamber, the means for separating including a wall having at least one aperture providing for air flow from the refuse containing chamber to the vacuum chamber, means for generating a vacuum in said vacuum chamber, a vacuum hose having opposite ends, one of said opposite ends being connected to said refuse containing chamber and the other of said opposite ends being adapted to be positioned adjacent one of the opposite ends of the elongated tube to draw air through the elongated tube into said vacuum hose, filter means for filtering air flowing through said aperture to confine the soot and combustion residue removed from the elongated tube in the refuse containing chamber, means providing a source of air pressure, and an air pressure hose having opposite ends, one of said opposite ends of said air pressure hose being connected to said source of air pressure, an air pressure operated cleaning tool connected to the other of said air pressure hose opposite ends, and being adapted to be inserted into the other of the opposite ends of the elongated tube to clean soot and combustion residue from the inside of the elongated tube, and said refuse containing chamber having a bottom portion including a trough adapted to receive material removed from the interior of the elongated tube.

28. Apparatus as set forth in claim 27 wherein said trough has a discharge opening and further including means for selectively discharging the material from said trough through said discharge opening, said means for discharging including an auger housed in said trough and means for selectively rotatably driving said auger.

29. Apparatus as set forth in claim 28 further including means for spraying liquid onto said materials discharged through said discharge opening.

30. Apparatus as set forth in claim 29 wherein said means for spraying includes a water tank, at least one spray nozzle adjacent said discharge opening, and means for connecting said spray nozzle to said water tank.

31. Apparatus as set forth in claim 30 wherein said means providing a source of air pressure includes air pressure tank and an air compressor operably connected to said air pressure tank.

32. Apparatus as set forth in claim 14 wherein said compressed air driven tool includes means for generating a flow of air from the compressed air driven tool toward the one end of the elongated tube.

* * * * *